US010774704B2

(12) United States Patent
Isoshima et al.

(10) Patent No.: US 10,774,704 B2
(45) Date of Patent: Sep. 15, 2020

(54) ENGINE HEAD COVER

(71) Applicant: KUBOTA Corporation, Osaka-shi, Osaka (JP)

(72) Inventors: Hiroaki Isoshima, Sakai (JP); Kentaro Shiraishi, Sakai (JP); Naotaro Nagai, Sakai (JP)

(73) Assignee: KUBOTA Corporation, Osaka-Shi, Osaka (JP)

( * ) Notice: Subject to any disclaimer, the term of this patent is extended or adjusted under 35 U.S.C. 154(b) by 66 days.

(21) Appl. No.: 15/832,106

(22) Filed: Dec. 5, 2017

(65) Prior Publication Data

US 2018/0171840 A1 Jun. 21, 2018

(30) Foreign Application Priority Data

Dec. 16, 2016 (JP) ..... 2016-244000

(51) Int. Cl.
*F01M 13/04* (2006.01)
*F01M 13/00* (2006.01)
*F01M 13/02* (2006.01)

(52) U.S. Cl.
CPC ..... *F01M 13/04* (2013.01); *F01M 13/0416* (2013.01); *F01M 2013/0038* (2013.01); *F01M 2013/026* (2013.01); *F01M 2013/0438* (2013.01); *F01M 2013/0461* (2013.01)

(58) Field of Classification Search
CPC ..... F01M 13/04; F01M 13/0416; F01M 2013/0038; F01M 2013/026; F01M 2013/0438; F01M 2013/0461
See application file for complete search history.

(56) References Cited

U.S. PATENT DOCUMENTS 4,627,406 A * 12/1986 Namiki ..... F01M 13/04 123/572
9,463,403 B2 * 10/2016 Wakabayashi ..... B01D 45/08
2014/0165512 A1 * 6/2014 Horiuchi ..... F01M 13/04 55/322

(Continued)

FOREIGN PATENT DOCUMENTS

EP 1275828 A2 1/2003
EP 1428992 A1 6/2004
EP 1790836 A2 5/2007

(Continued)

OTHER PUBLICATIONS

Extended European Search Report issued Apr. 26, 2018 in EP Application No. 17202348.3.

*Primary Examiner* — Syed O Hasan
(74) *Attorney, Agent, or Firm* — Panitch Schwarze Belisario & Nadel LLP

(57) ABSTRACT

In an engine head cover, an upper portion of a partition plate 5, which partitions an inside of a head cover 3 into upper and lower portions, forms a blowby gas passage W having an inlet 6 and an outlet 7 communicating with an intake path 9. A PCV valve 14 disposed on the outlet 7 side, a filter 13 disposed on the inlet 6 side, and a labyrinth 15 disposed between the PCV valve 14 and the filter 13 are provided. A recovery hole 23 which causes a flowdown of trapped oil is formed at a portion on a downstream side of the filter 13 in a flow direction of a blowby gas in the blowby gas passage W and on a lower side of the labyrinth 15 and the pressure regulating valve 14.

13 Claims, 7 Drawing Sheets

(56) References Cited

U.S. PATENT DOCUMENTS

| | | | | |
|---|---|---|---|---|
| 2015/0176479 | A1* | 6/2015 | Hamaguchi ..... | F02B 29/0468<br>137/468 |

FOREIGN PATENT DOCUMENTS

| | | | |
|---|---|---|---|
| EP | 3009620 | A1 | 4/2016 |
| JP | 2013148010 | A | 8/2013 |
| WO | 02099255 | A1 | 12/2002 |

* cited by examiner

FLOW OF BLOWBY GAS
REAR
FRONT
INTAKE PATH
ACCUMULATED OIL
3A
5a
3s
6
13
W
34
9
15
19a
19
17
17a
17b
7
14
35
36
22
4a
8
5A
26
24
24a
25
23
5b
18
h
H
4
5
1
1B
3
2
E
3B

ENGINE HEAD COVER

CROSS-REFERENCE TO RELATED APPLICATION

This application claims priority under 35 U.S.C. § 119(b) to Japanese Application No. 2016-244000, filed Dec. 16, 2016, the disclosure of which is incorporated herein by reference in its entirety.

BACKGROUND OF THE INVENTION

(1) Field of the Invention

The present invention relates to an engine head cover.

(2) Description of Related Art

Conventionally, in a blowby gas recirculation structure of an engine, oil separated from a blowby gas by a filter or a maze (labyrinth) is returned to an inside of an engine through a return hole on a shielding plate that forms a blowby gas passage in a head cover.

SUMMARY OF THE INVENTION

In the above-described conventional art, oil or an oil mist reversely flowing from a return port of trapped oil flows directly from a blowby gas outlet to the intake system. Thus, there are concerns that not only an oil trapping rate (oil throw performance) deteriorates but also the oil consumption amount is increased.

An object of the present invention is to improve an engine head cover which includes a blowby gas passage having a PCV valve and a filter inside a head cover, by further devising a structure, to enable a flowdown of trapped oil to a valve chamber without deteriorating oil throw performance and increasing an oil consumption amount.

The present invention is an engine head cover which includes a blowby gas passage for guiding a blowby gas in a crankcase to an intake path through an inside of a head cover attached to a cylinder head, the engine head cover including: a pressure regulating valve disposed on an outlet side of the blowby gas passage; a filter disposed on an inlet side of the blowby gas passage; a labyrinth disposed between the pressure regulating valve and the filter in the blowby gas passage; and a recovery hole which causes a flowdown of oil trapped in the blowby gas passage, in which the recovery hole is formed at a portion on a downstream side of the filter and on a lower side of the labyrinth and the pressure regulating valve.

According to the present invention, the recovery hole is disposed at a portion below and away from the labyrinth or the pressure regulating valve at a terminal end portion of the flow of the blowby gas in the head cover. Therefore, even if oil or an oil mist reversely flows from the recovery hole, there is a level difference between the outlet of the blowby gas and the recovery hole and influence by the flow of the blowby gas is hardly received. Therefore, a flow of the reversely flowing oil from the outlet to the intake system is restricted as much as possible.

As a result, it is possible to provide an engine head cover which is improved to improve an oil trapping rate (oil throw performance) and reduce the oil consumption amount.

BRIEF DESCRIPTION OF THE DRAWINGS

FIG. 6A is a cross-sectional view taken along line A-A in FIG. 5, and FIG. 6B is a bottom view; FIG. 7A is a plan view, and FIG. 7B is a cross-sectional view taken along line A-A in FIG. 7A.

DETAILED DESCRIPTION OF PREFERRED EMBODIMENTS

Hereinafter, an embodiment of an engine head cover according to the present invention will be described with reference to the drawings in the case of a vertical multi-cylinder engine. Front, rear, left, and right sides of the engine in the case where a side of engine cooling fan (not illustrated) is the front side are illustrated in each figure for reference.

First Embodiment

Figure 1:
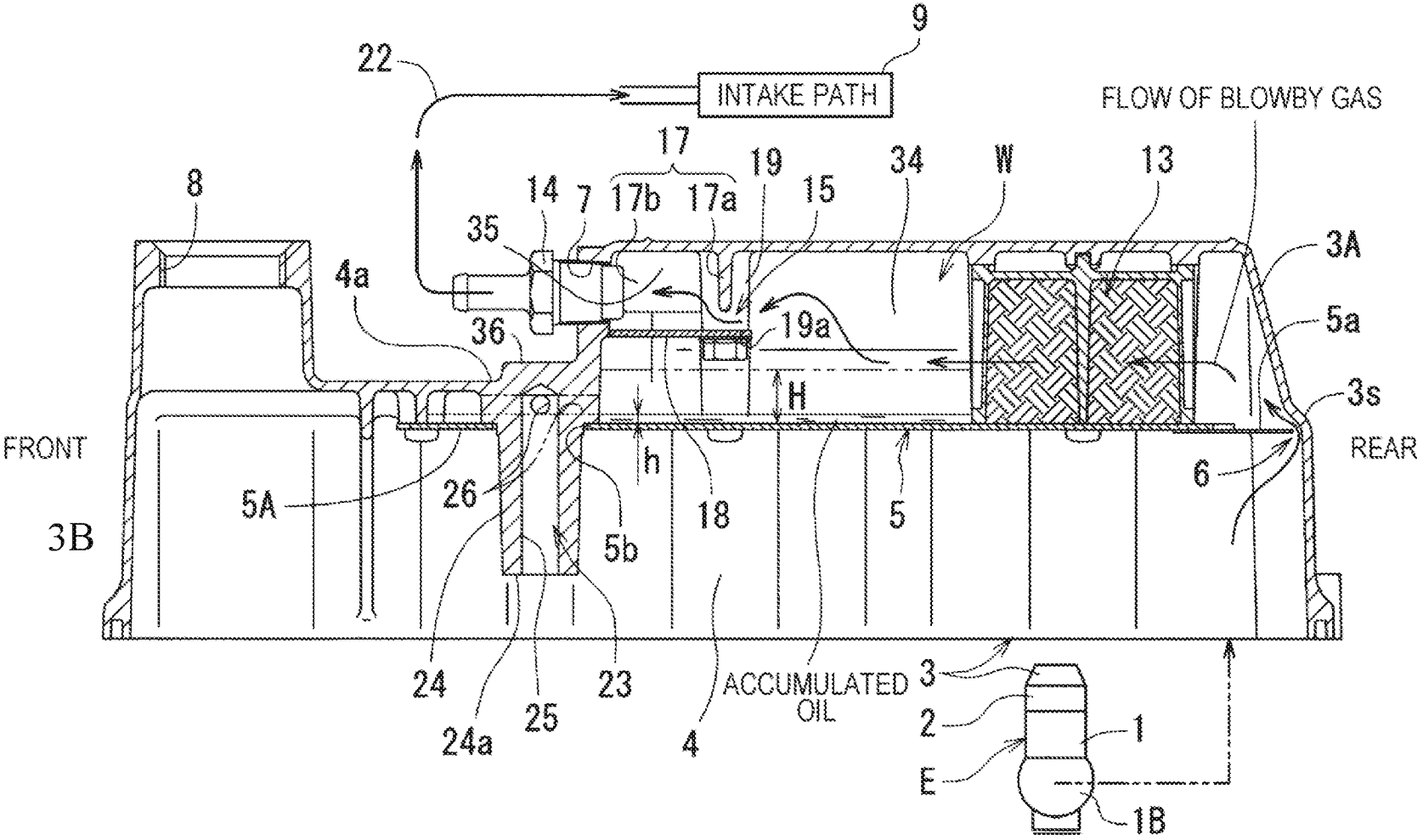
FIG. 1 is a longitudinal cross-sectional view illustrating an internal structure of a head cover.

As illustrated in FIG. 1, in a vertical multi-cylinder engine E, a cylinder head 2 is assembled to an upper portion of a cylinder block 1. A cylinder head cover (hereinafter simply referred to as a head cover) 3 is assembled to an upper portion of the cylinder head 2. A valve device (not illustrated) is formed in the cylinder head 2 in such a manner as to protrude upward from the cylinder head 2. The head cover 3 is a component which covers the valve device (not illustrated) and serves as a lid for the cylinder head 2.

Figure 2:
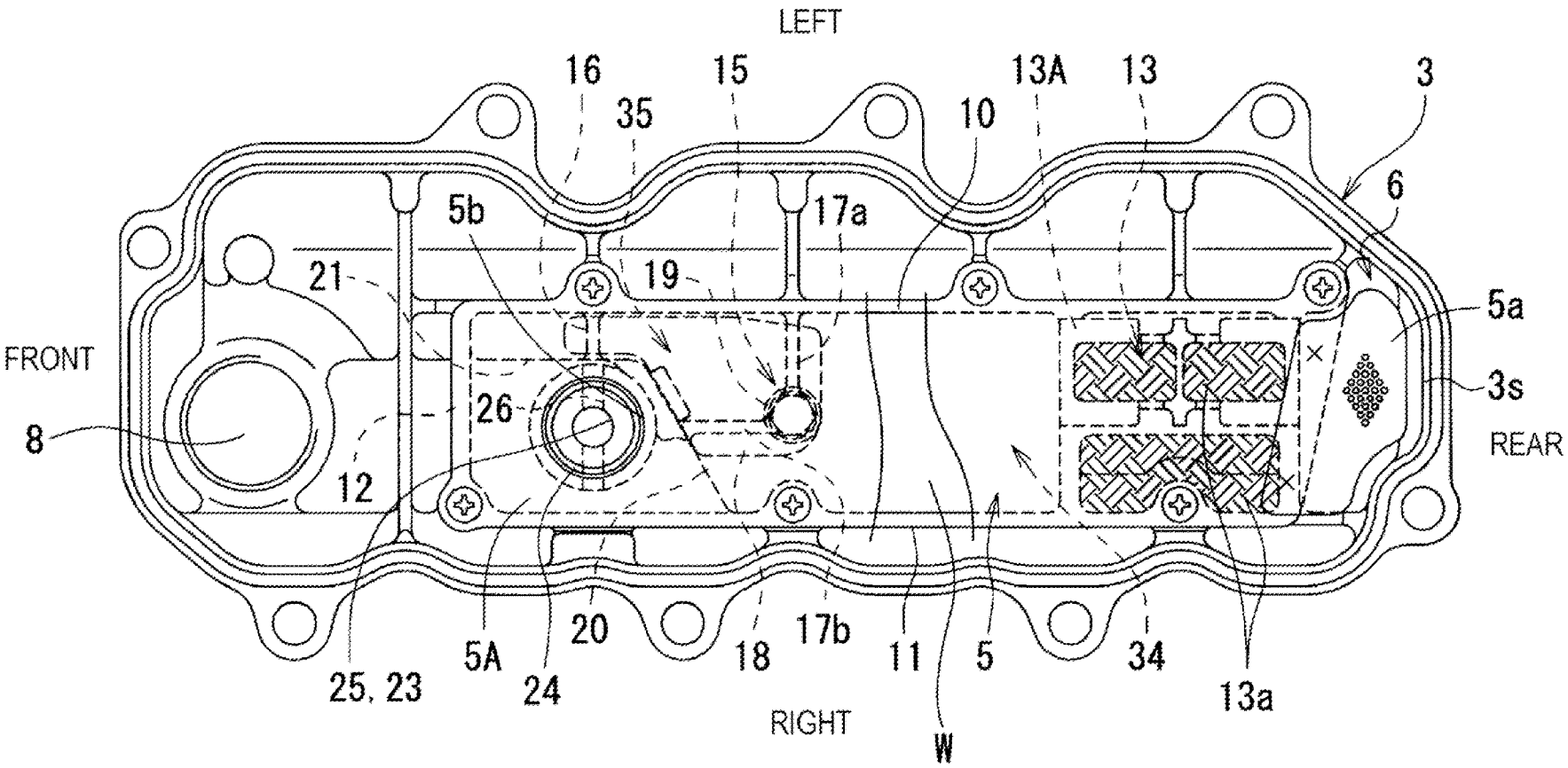
FIG. 2 is a bottom view of the head cover in FIG. 1.
Figure 3:
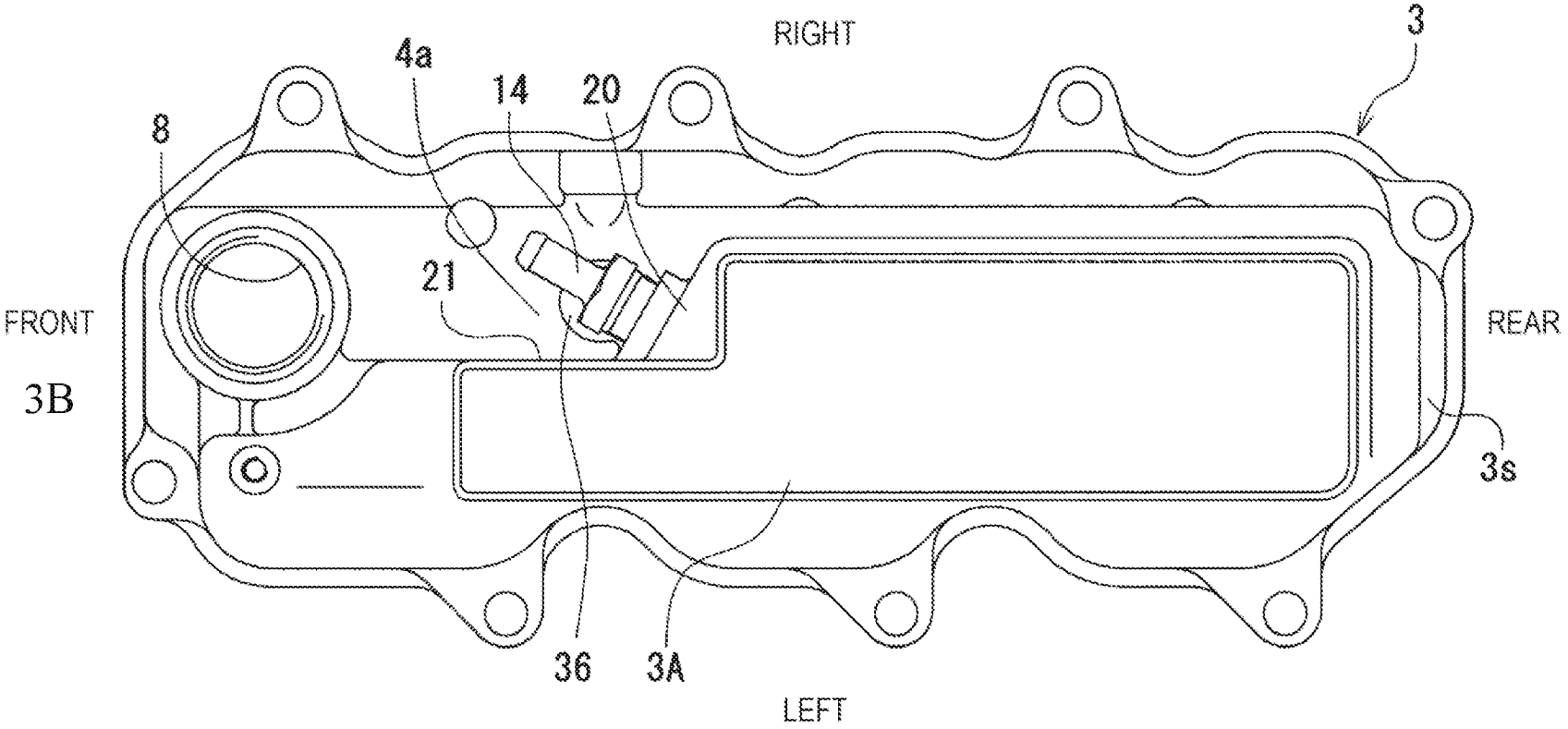
FIG. 3 is a plan view of the head cover in FIG. 1.

As illustrated in FIGS. 1 to 3, the head cover 3 is provided with a partition plate (an example of a partition structure) 5 made of a steel plate which partitions an internal space into upper and lower portions. An upper space portion which is the upper portion of the partition plate 5 is formed in a blowby gas passage W having an inlet 6 which communicates with the interior of a crankcase 1B and an outlet 7 which communicates with an intake path 9. A portion inside the head cover 3 below the partition plate 5 is a housing space portion (valve chamber) 4 which covers the valve device (not illustrated). That is, the engine head cover includes a partition structure 5 which partitions an inside of the head cover 3 into upper and lower portions, and in which the upper portion forms the blowby gas passage W.

The head cover 3 having a rectangular shape which is long in a longitudinal direction in a plan view has a cross-sectional shape having a downward open U-shape. As illustrated in FIG. 3, an upper cover portion 3A having a planar upper surface and which forms the blowby gas passage W is formed in a shape protruding upward from a lower cover portion 3B. On a front side of the upper cover portion 3A, an oil supply port 8 is formed so as to protrude upward from the lower cover portion 3B.

As illustrated in FIGS. 1 and 2, the head cover 3 includes therein a plurality of reinforcing ribs extending downward. The plurality of reinforcing ribs include a left vertical rib 10 and a right vertical rib 11 extending in the longitudinal direction, and a coupling horizontal rib 12 which connect front end portions of the left vertical rib 10 and the right vertical rib 11. The partition plate 5 is screwed in a state where the lid is placed over distal end surfaces (lower end surfaces) of the left and right vertical ribs 10 and 11 and the coupling horizontal rib 12. The partition plate 5 includes a partition main body 5A and an inlet plate 5*a* fixed to the partition main body 5A. The inlet 6 of the blowby gas passage W is formed by a gap between the inlet plate 5*a* and a cover sidewall 3*s*, i.e., a gap having a substantially C shape in a plan view. The inlet plate 5*a* may be made of a plate material having multiple holes such as a punching metal.

A filter 13 is disposed on the inlet side of the blowby gas passage W surrounded by the upper cover portion 3A and the partition plate 5, and traps oil contained as an oil mist in a blowby gas. The outlet 7 of the blowby gas passage W is a longitudinally and laterally extending opening formed at a front end portion of the upper cover portion 3A. A PCV valve (an example of a pressure regulating valve) 14 is screwed to a taper thread formed at the outlet 7. In addition, a labyrinth 15 is formed between the PCV valve 14 and the filter 13 in the blowby gas passage W and close to the PCV valve 14, and causes the blowby gas to make a detour by a bent path.

The filter 13 is configured by a filter case 13A and a pair of filter media 13*a* and 13*a* installed in the filter case 13A, and is sandwiched between the upper cover portion 3A and the partition plate 5 at the inlet side of the blowby gas passage W. Therefore, the blowby gas entering from the inlet 6 to the blowby gas passage W passes through the filter 13, then flows toward the outlet 7 after the oil component is removed as much as possible. As the filter medium 13*a*, various materials such as a metal mesh and a glass fiber can be used.

Figure 4:
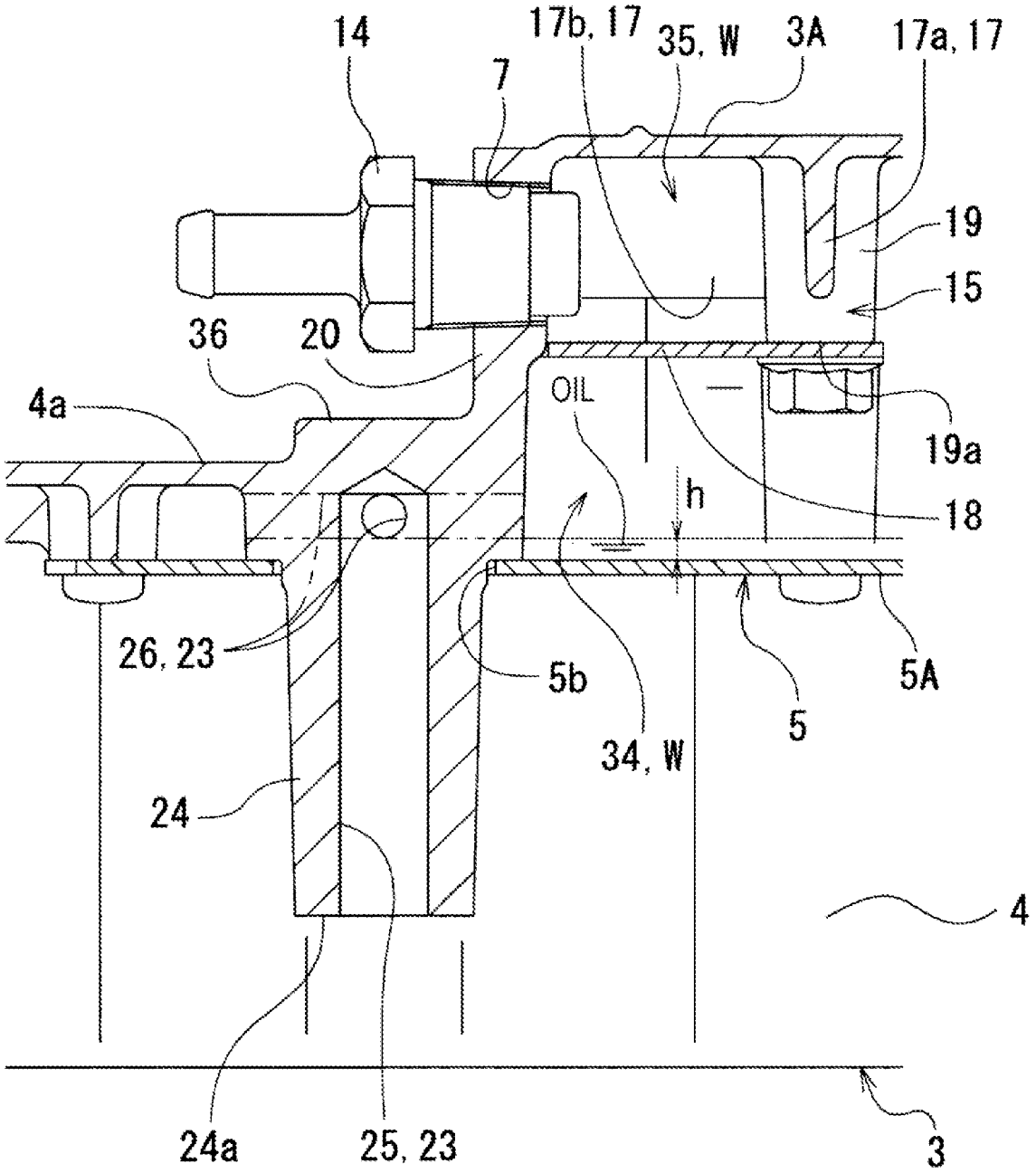
FIG. 4 is an enlarged cross-sectional view of a main portion illustrating a structure of a terminal end portion of a blowby gas passage.

As illustrated in FIGS. 1, 2, and 4, the labyrinth 15 is formed by providing a partition member 18 made of the steel plate disposed immediately before the PCV valve 14. The partition member 18 is bolted to a bolt seat 19 in a state where the partition member 18 is in contact with distal end surfaces (lower end surfaces) of a first horizontal rib 16 and the bolt seat 19 formed inside the upper cover portion 3A. The first horizontal rib 16 is a rib wall which is formed over a short sidewall 21 on the front side of the upper cover portion 3A, and the left vertical rib 10, and is short in left and right directions.

The bolt seat 19 is formed at a bent middle portion of an L-shaped rib 17 formed over an oblique sidewall 20 having the outlet 7 and the left vertical rib 10. A protrusion amount of the L-shaped rib 17 including a horizontal rib portion 17*a* and a vertical rib portion 17*b* is slightly smaller than that of the seat surface 19*a* of the bolt seat 19. A gap between the horizontal and vertical rib portions 17*a*, 17*b* and the partition member 18 is configured as a bent maze, and a labyrinth 15 which guides the blowby gas to the PCV valve 14 by causing the blowby gas to make a detour.

As illustrated in FIGS. 1 to 4, the PCV valve 14 is screwed to the outlet 7 formed by the taper thread formed in the above-described oblique sidewall 20 of the upper cover portion 3A, and also substantially serves as the outlet of blowby gas passage W. As illustrated in FIG. 1, the blowby gas having passed through the PCV valve 14 is recirculated to the intake path 9 through a blowby path 22 such as a tube.

As illustrated in FIG. 1, the blowby gas from the crankcase 1B enters from the housing space portion 4 in the blowby gas passage W through the inlet 6. The blowby gas having passed through the filter 13 disposed near the inlet 6 passes through the labyrinth 15, passes through the PCV valve 14 which is the outlet 7, and then recirculates to the intake path 9. The blowby gas passage W includes a passage main portion 34 which extends between the filter 13 and the labyrinth 15 and below the labyrinth 15, and a PCV front chamber (an inlet portion of the PCV valve 14) 35 which includes the outlet 7 surrounded by the partition member 18 and the labyrinth 15.

As illustrated in FIGS. 1, 2 and 4B, a recovery hole 23 which causes a flowdown of oil trapped in the blowby gas passage W is formed at a portion on a downstream side of the filter 13 in a flow direction of the blowby gas in the blowby gas passage W and on a lower side of the labyrinth 15 and the PCV valve 14. More specifically, at a portion at a side next to the upper cover portion 3A and immediately below the PCV valve 14, the recovery hole 23 is formed in a hanging portion 24 having a vertically elongated columnar shape and formed protruding downward while penetrating a circular hole 5*b* of the partition plate 5 from a ceiling wall 4*a* of the housing space portion 4 of the head cover 3. A reinforcing wall 36 is formed at a portion of the ceiling wall 4*a* corresponding to the hanging portion 24, and bulges slightly upward.

A vertically elongated hole 25 is formed upward from a bottom surface 24*a* in the hanging portion 24. A horizontal hole 26, which communicates with an upper end portion of the vertically elongated hole 25 and is open in the blowby gas passage W, is formed. That is, the recovery hole 23 is formed by the vertically elongated hole 25 and the horizontal hole 26. Further, the lowest point (hole bottom) of the horizontal hole 26 is set slightly higher than the upper surface of the partition plate 5 by a height h.

Due to a continuous operation of the engine E, scattered oil trapped mainly by the filter 13 accumulates on the partition plate 5 in the blowby gas passage W. As illustrated in FIG. 1, when the oil accumulates at the height h or more on the partition plate 5, the oil passes from the horizontal hole 26 through the recovery hole 23 and flows down (drops) to the housing space portion 4. In addition, while the engine E is stopped, it is possible to cause oil which accumulates in a short time to flow down from the recovery hole 23.

A differential pressure between the blowby gas passage W and the housing space portion 4 during the operation of the engine E is approximately 10 mmAq. A long-term continuous operation stabilizes an oil surface at a head (vertical difference) corresponding to 10 mmAq from the horizontal hole 26 (from the height h) (see FIG. 1). The vertically elongated hole 25 is opened at a position of the housing space portion 4 where a component (a rocker arm or a retainer) which scatters the oil is not present, to reduce the flow of the oil mist from the recovery hole 23 into the blowby gas passage W without passing through the filter 13.

In addition, the presence of the recovery hole 23 which short-circuits the blowby gas passage W and the housing space portion 4 is likely to cause air bubbles to escape from the horizontal hole 26 to the blowby gas passage W, and scatter the oil. However, the labyrinth 15 is located with respect to the recovery hole 23 in the flow direction of the blowby gas and on the upstream side, so that the following operation and effect are obtained.

That is, the partition member 18 which partitions the labyrinth 15 and the PCV valve 14, and the recovery hole 23 into the upper and lower sides serves as a partition wall. The horizontal hole 26 communicates with (or is directly connected to) the blowby gas passage W at a portion between the filter 13 and the labyrinth 15. That is, the horizontal hole 26, and the PCV front chamber 35 which is an inlet portion of the PCV valve 14 communicate via the labyrinth 15 in a detour. Reverse flow air bubbles from the recovery hole 23 join as a flow in a direction opposite to the flow of the blowby gas. Therefore, the presence of the labyrinth 15 whose flow direction is different in a detour and which exhibits the function of shaking off the oil mist by the maze provides an effect of minimizing a negative influence that the scattered oil from the recovery hole 23 which does not pass through the filter 13 reaches the outlet 7.

In addition, the partition member 18 which serves as a partition wall against the reverse flow oil mist from the recovery hole 23 is formed as a structure which forms the labyrinth 15. Consequently, it is possible to provide an advantage of realizing rationalization such as cost reduction and efficient utilization of space as a result of use of members in combination. That is, the engine head cover includes a partition member 18 which partitions the labyrinth 15 and the pressure regulating valve 14, and the recovery hole 23 into upper and lower sides to communicate a portion between the filter 13 and the labyrinth 15 in the blowby gas passage W, and the recovery hole 23.

In addition, air bubbles may escape from the horizontal hole 26 to the blowby gas passage W, scatter the oil and increase the carryover. That is, the height of the oil accumulated on the partition plate 5 may rise to approximately the height H position indicated by a virtual line in FIG. 1.

However, the scattered oil is likely to flow together with the air bubbles from the recovery hole 23 into the blowby gas passage W. However, the labyrinth 15 is disposed on the upstream side in the flow direction of the blowby gas and is located above with respect to the horizontal hole 26. Consequently, the partition member 18 serves as the partition wall to minimize the influence of the scattering oil.

Second Embodiment

Figure 5:
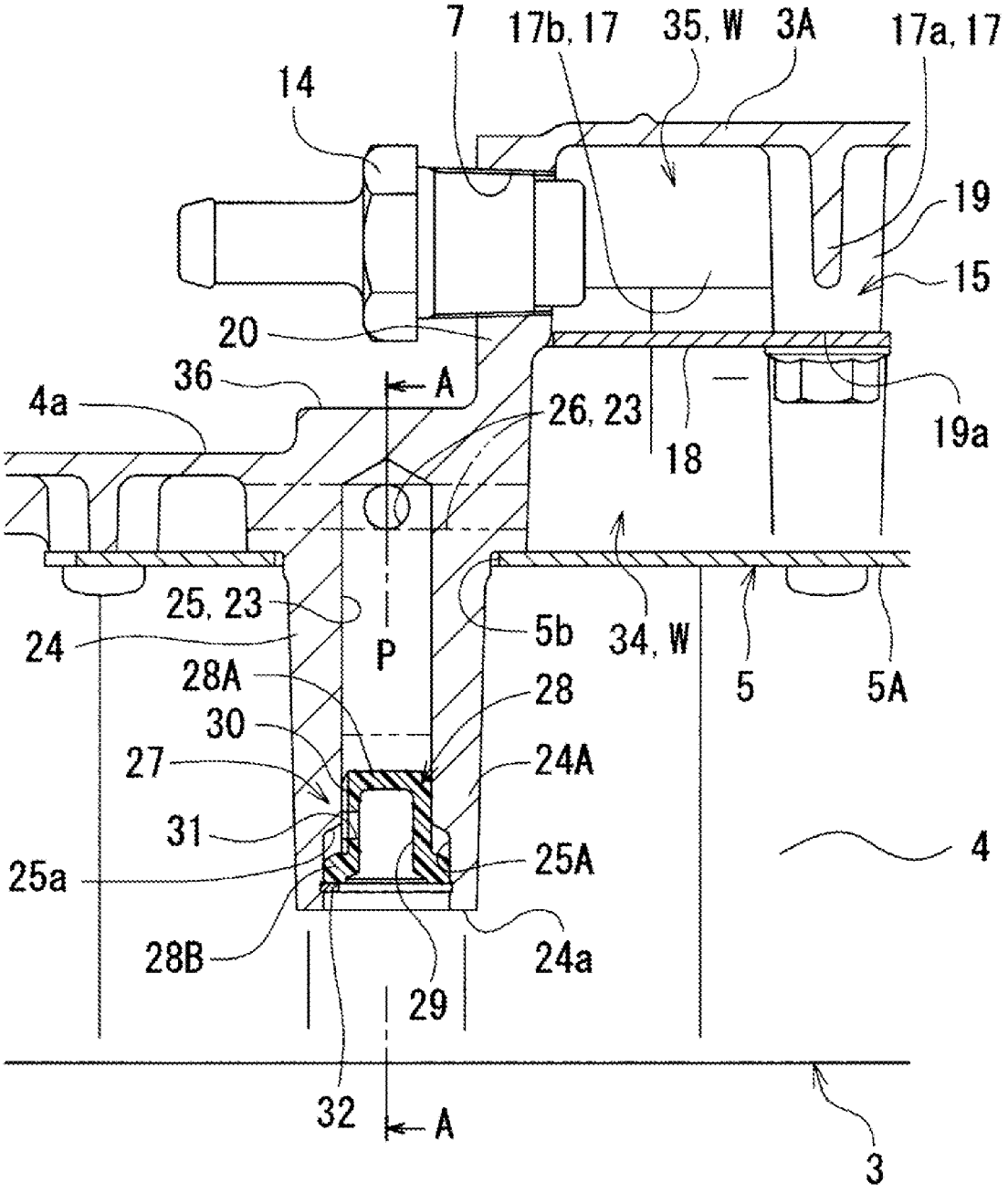
FIG. 5 is an enlarged cross-sectional view of a main portion illustrating a head cover having a specification with an on-off valve.
Figure 6A:
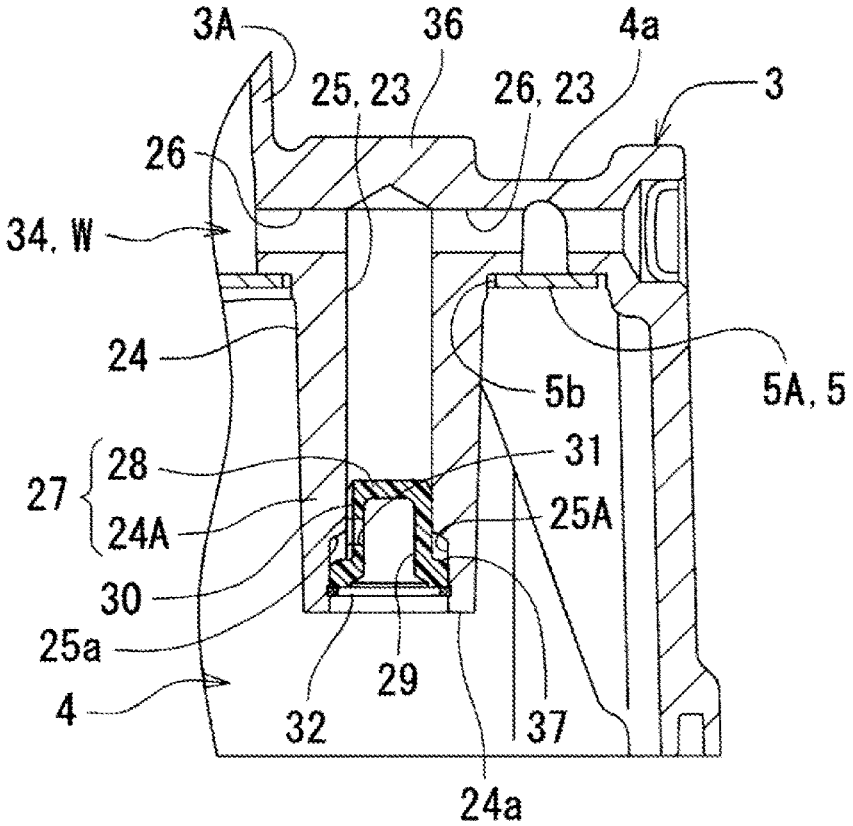
FIGS. 6A and 6B illustrate an on-off valve portion, where
Figure 6B:
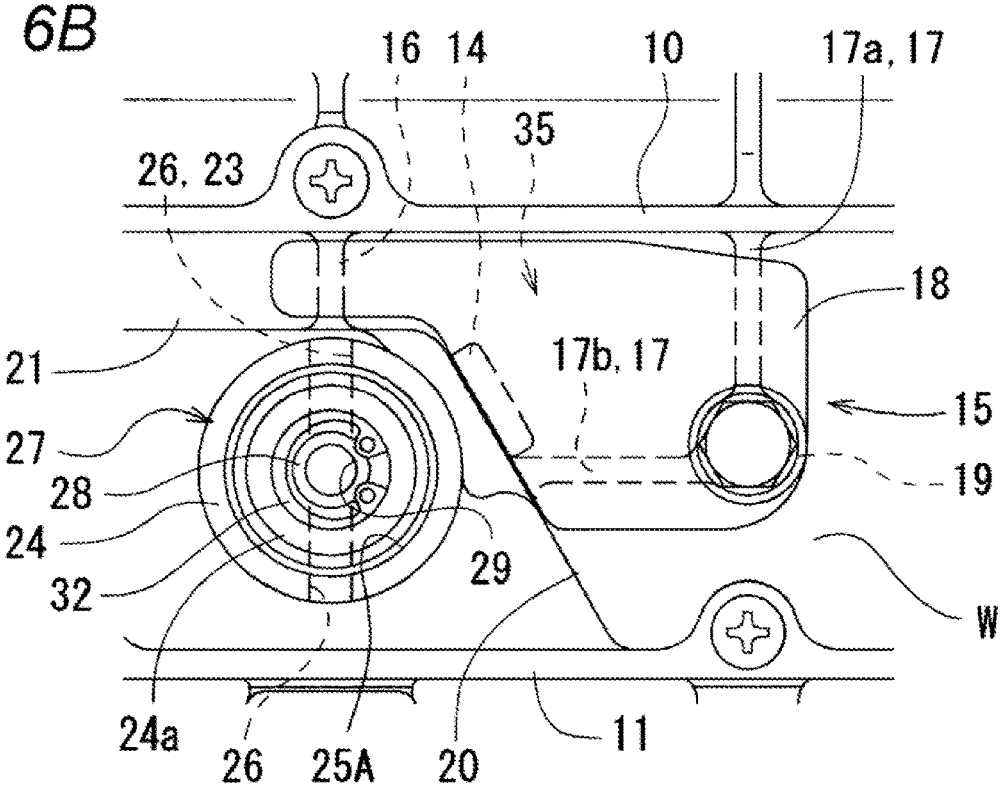

As illustrated in FIGS. 5, 6A, and 6B, the head cover 3 may include an on-off valve 27 provided at a lower portion of a recovery hole 23. The head cover 3 according to the second embodiment is the same as the head cover of the first embodiment illustrated in FIG. 1 except that the on-off valve 27 is added. The on-off valve 27 provided at the lower portion of the recovery hole 23, more specifically, at a lower end portion of a vertically elongated hole 25 is formed by a lower end portion 24A of the hanging portion 24 and a valve body 28.

As illustrated in FIG. 5, the valve body 28 having an axial center P includes a valve main body portion 28A which is slidably fitted to the vertically elongated hole 25, a valve flange portion 28B which is slidably fitted in a large diameter hole portion 25A at a lower end of the elongated hole 25, and a hole portion 29 which is recessed upward. In an outer peripheral portion of the valve main body portion 28A, vertical slits 30 which open upward and terminate in the valve flange portion 28B are formed, and laterally extending communication holes 31 which opens in a hole portion 29 and penetrates in a radial direction is formed. The large diameter hole portion 25A is provided with a circlip 32 which prevents the valve body 28 from falling down.

Figure 7A:
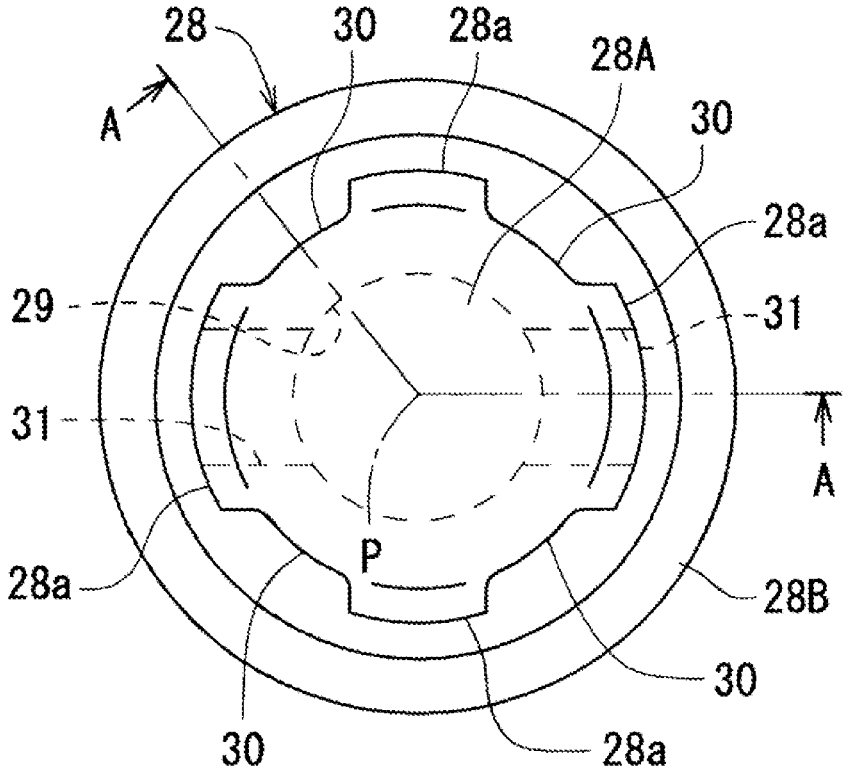
FIGS. 7A and 7B illustrate a valve body, where
Figure 7B:
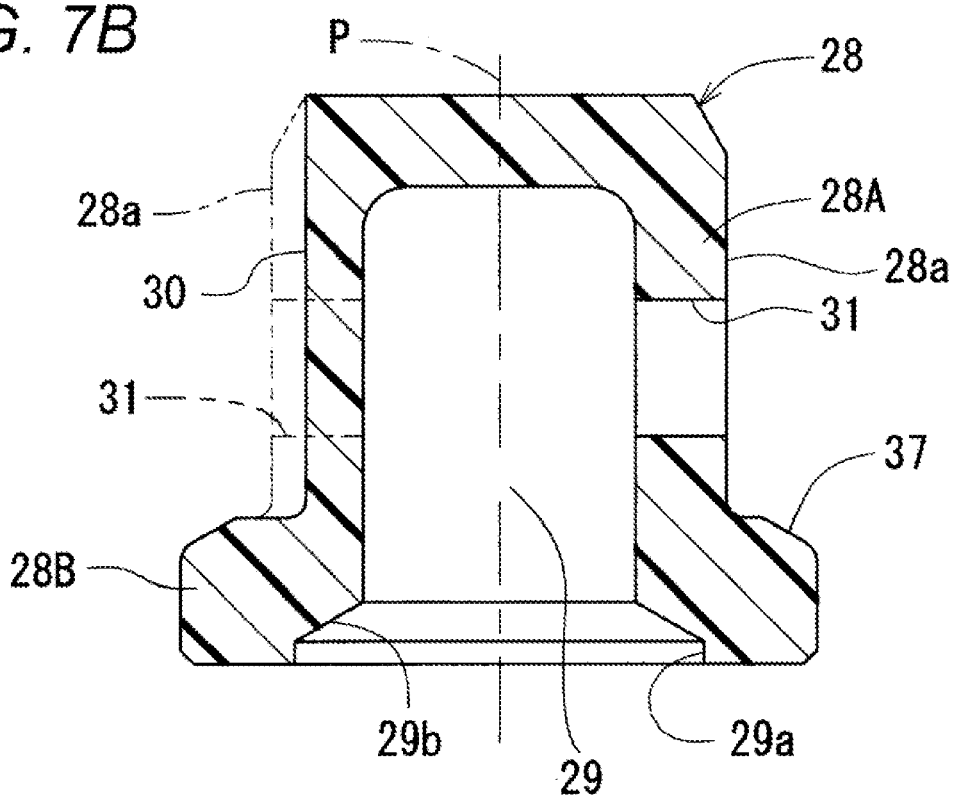

The structure of the valve body 28 will be described in detail. As illustrated in FIGS. 7A and 7B, the four vertical slits 30 in total are formed per equal angle (90 degrees) in a circumferential direction with respect to the axial center P, and outer circumferential surfaces 28*a* which are fitted with the vertically elongated hole 25 are formed at four portions between the neighboring vertical slits 30. The above-described communication holes 31 are formed at two portions penetrating the two of the four outer circumferential surfaces 28*a*, two outer circumferential surfaces 28*a* and 28*a* having circumference lengths slightly long and being opposed to each other.

An upper end corner peripheral portion of the valve main body portion 28A and an upper end corner peripheral portion of the valve flange portion 28B are chamfered. The circumferential upper surface 25*a* of the large diameter hole portion 25A and the chamfered portion 37 of the valve flange portion 28B are chamfered at the same angle to enable surface contact. When the valve body 28 is raised to a highest position (a position indicated by a virtual line in FIG. 5), the circumferential upper surface 25*a* and the chamfered portion 37 come into surface contact with each other to form a seal portion. The hole portion 29 has a large diameter opening hole portion 29*a* and a tapered hole portion 29*b* whose diameter is reduced from the large diameter opening hole portion 29*a* in the valve flange portion 28B.

As shown in FIGS. 5 and 6A, the on-off valve 27 is located at a lowermost position at which the valve body 28 is supported by the circlip 32 in a free state. An upper portion of the valve body 28 in the vertically elongated hole 25 and the hole portion 29 communicate with each other via the vertical slits 30, a circumferential space portion 33 formed at an upper side of the valve flange portion 28B in the large diameter hole portion 25A, and a communication hole 31. Therefore, oil recovered on the partition plate 5 can flow down through the recovery hole 23 and the on-off valve 27, and can be recovered.

During operation of an engine E, a differential pressure between the blowby gas passage W and the housing space portion 4 moves the valve body 28 upward, the circumferential upper surface 25*a* and the chamfered portion 37 come into contact with each other, and the on-off valve 27 is placed in a closed state (a state where the valve body 28 is raised to the position of the virtual line illustrated in FIG. 5). This closed valve state prevents a reverse flow from the recovery hole 23 to the blowby gas passage W.

Then, when the recovered oil accumulated on the partition plate 5 is a prescribed amount (e.g., a head difference of approximately 25 mm Aq of a ventilation resistance of a filter 13) or more, the above differential pressure disappears, the valve body 28 is lowered until the valve body 28 comes into contact with the circlip 32, and the on-off valve 27 is placed in an open state. In this open state, the oil flows down to the housing space portion 4. Even while the engine E is stopped, the on-off valve 27 is in the open state.

An on-off valve 27 which is opened when a differential pressure between a pressure of the blowby gas passage W and a pressure of the housing space portion 4 becomes smaller than a predetermined value, and is closed when the differential pressure becomes larger than a predetermined value is provided at a lower end portion of the recovery hole 23. Consequently, during the operation of the engine E, a reverse flow from the recovery hole 23 is prevented. In addition, when the recovered oil accumulates in the blowby gas passage W to some extent, it is possible to cause the oil to flow down from the blowby gas passage W to the housing space portion 4 through the recovery hole 23.

Therefore, oil or an oil mist reversely flowing from the recovery hole 23 are restricted from flowing directly from the outlet 7 into the intake path 9. As a result, an oil trapping rate (oil throw performance) is further improved, and the oil consumption amount is drastically reduced, so that it is possible to provide a further improved engine head cover.

What is claimed is:

1. An engine head cover which includes a blowby gas passage, the engine head cover comprising:

a pressure regulating valve disposed on an outlet side of the blowby gas passage;

a filter disposed on an inlet side of the blowby gas passage;

a labyrinth disposed between the pressure regulating valve and the filter in the blowby gas passage;

a recovery hole which causes a flowdown of oil trapped in the blowby gas passage; and a partition member positioned upstream of the recovery hole and partitions the labyrinth and the pressure regulating valve from the recovery hole into respective upper and lower sides of the blowby gas passage, to communicate a portion of the blowby gas passage between the filter and the labyrinth and a portion of the blowby gas passage between the filter and the recovery hole, wherein the blowby gas passage is formed above a valve chamber inside the engine head cover; and wherein the recovery hole is formed at a portion on a downstream side of the filter and on the lower side of the labyrinth and the pressure regulating valve.

2. The engine head cover according to claim 1, further comprising a partition structure which partitions an inside of the head cover into upper and lower portions, and in which the upper portion forms the blowby gas passage.

3. The engine head cover according to claim 2, wherein the recovery hole is formed in a vertically elongated hanging portion formed protruding downward while penetrating the partition structure.

4. The engine head cover according to claim 1, wherein the partition member is a structure which forms the labyrinth.

5. The engine head cover according to claim 2, wherein the partition member is a structure which forms the labyrinth.

6. The engine head cover according to claim 3, wherein the partition member is a structure which forms the labyrinth.

7. The engine head cover according to claim 1, further comprising an on-off valve of the recovery hole.

8. The engine head cover according to claim 2, further comprising an on-off valve of the recovery hole.

9. The engine head cover according to claim 3, further comprising an on-off valve of the recovery hole.

10. The engine head cover according to claim 4, further comprising an on-off valve of the recovery hole.

11. The engine head cover according to claim 5, further comprising an on-off valve of the recovery hole.

12. The engine head cover according to claim 6, further comprising an on-off valve of the recovery hole.

13. An engine comprising the engine head cover as claimed in claim 1, wherein the blowby gas passage is arranged to guide a blowby gas in a crankcase to an intake path through an inside of the head cover, which is attached to a cylinder head.

* * * * *